United States Patent [19]

Stillman

[11] Patent Number: 5,044,377

[45] Date of Patent: Sep. 3, 1991

[54] APPARATUS FOR PERIODICALLY VARYING THE ELEVATION OF A HUMAN SUBJECT

[76] Inventor: Arnold Stillman, 5756 Montessa Dr., Camarillo, Calif. 93010

[21] Appl. No.: 465,382

[22] Filed: Jan. 16, 1990

Related U.S. Application Data

[63] Continuation-in-part of Ser. No. 158,788, Feb. 22, 1988, abandoned.

[51] Int. Cl.[5] ..... A61G 15/00

[52] U.S. Cl. ..... 128/845; 128/897; 5/62

[58] Field of Search ..... 600/9, 15; 128/845, 128/897, 898; 269/322, 323; 5/60, 62, 63, 66; 378/208, 209

[56] References Cited

U.S. PATENT DOCUMENTS

| | | | |
|---|---|---|---|
| 3,216,423 | 11/1965 | Blonsky et al. | 606/121 |
| 3,397,411 | 8/1968 | Rossi | 5/66 |
| 4,330,892 | 5/1982 | Fukushima | 600/9 |
| 4,537,181 | 8/1985 | Shalhoob et al. | 600/9 |
| 4,890,629 | 1/1990 | Capelo et al. | 128/897 |

*Primary Examiner*—Lee S. Cohen
*Assistant Examiner*—John P. Lacyk
*Attorney, Agent, or Firm*—Freilich, Hornbaker & Rosen

[57] ABSTRACT

An apparatus for supporting a reclined human subject while periodically and gradually varying the elevation of the subject's head and feet. The apparatus includes a support platform mounted for rotation in its plane with respect to an axis extending normal to it and inclined from vertical.

4 Claims, 3 Drawing Sheets fig.4.
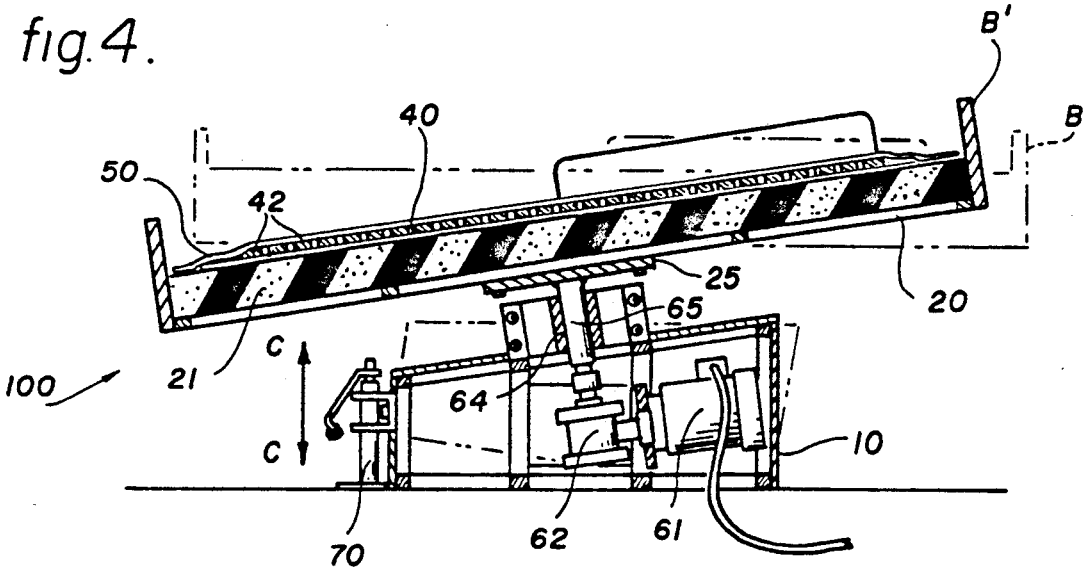
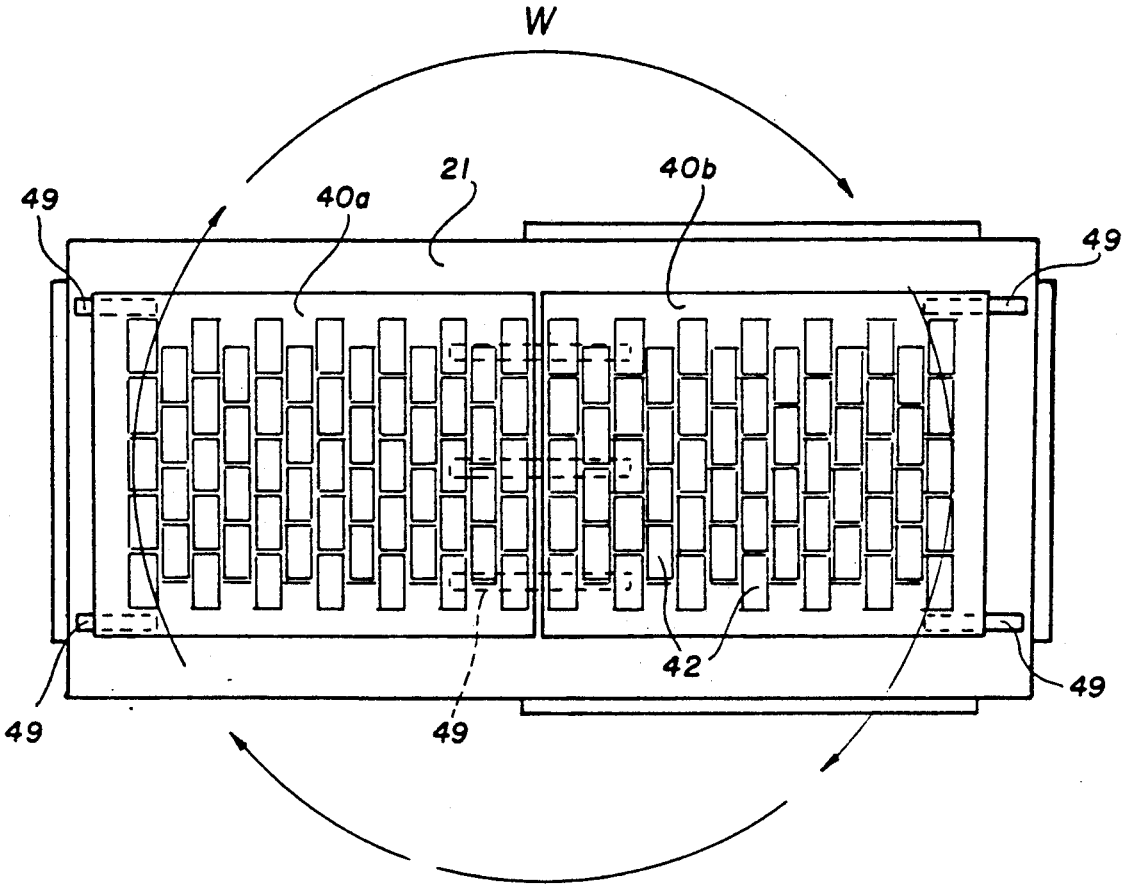
fig.5.

APPARATUS FOR PERIODICALLY VARYING THE ELEVATION OF A HUMAN SUBJECT

RELATED APPLICATIONS

This application is a continuation in part of U.S. application No. 158,788 filed Feb. 22, 1988 now abandoned.

BACKGROUND OF THE INVENTION

1. Field of the Invention

This invention relates generally to apparatus for supporting a reclined human subject and moving his extremities through periodic and gradual changes in elevation. The apparatus enables a user to experience sensations which have been reported to be soothing, relaxing, and beneficial.

2. Prior Art

U.S. Pat. No. 4,256,095 (Graham, 1981) discloses an electromechanical therapeutic apparatus for rotating a human subject about a horizontal axis and through a continuum of horizontal planes, while subjecting the human subject to a low energy electrical field developed by an AC generator.

U.S. Pat. No. 3,373,738 (Wittke, 1968) discloses an electromechanical apparatus for oscillating a bed in a horizontal plane to therapeutically benefit the occupant.

U.S. Pat. No. 4,586,492 (Manahan, 1986) discloses a therapeutic bed that includes a base frame, an intermediate frame adapted to pivot about its central lateral axis with respect to the base frame, and an upper frame adapted to pivot about its central longitudinal axis with respect to the intermediate frame, wherein separate electromechanical means, each employing a rotating eccentric arm, oscillate the respective pivoting frames.

U.S. Pat. No. 4,537,181 (Shalhoof et al, 1985) discloses an apparatus for treatment of arthritis that includes a seat disposed between a pair of rotatable magnetic field generators.

U.S. Pat. No. 4,330,892 (Fukushima, 1982) discloses a therapeutic mattress that incorporates a plurality of permanent magnets having a magnetic flux density of 500 gauss or more.

U.S. Pat. No. 4,549,532 (Baerman, 1985) discloses a flexible magnetic sheet for therapeutic use in which permanent-magnetic ferrite particles are incorporated into synthetic elastomeric material and wherein the sheet surface facing the body site to be treated has been magnetized to provide concentrically disposed magnetic poles of alternating polarities.

SUMMARY OF THE INVENTION

The present invention relates to apparatus for supporting a reclined human subject while concurrently periodically and gradually changing the elevation of the user's head and feet.

In accordance with a preferred embodiment, a support platform is mounted for rotation in its plane with respect to an axis extending normal to it. The axis is inclined from vertical to thereby tilt the platform with respect to the horizontal. In use, as the platform is rotated, the extremities of a user reclining on the platform will traverse a path whose elevation changes gradually and periodically. More specifically, the subject's head and feet will each be alternately elevated and depressed about a median elevation.

In a preferred application of the invention, the axis of rotation is inclined up to about 20° from vertical and the platform is rotated at about between 0.5 and 25 revolutions per minute. Users report that they experience sensations of "floating" or "weightlessness" which they find to be soothing and relaxing. Additionally, some health professionals (e.g. see *Sensory Integration and Learning Disorders*, by A. Jean Ayres, Western Psychological Services, 8th printing, August 1983) report that periodic and gradual motion may have beneficial therapeutic effects in the treatment of learning disorders such as dyslexia.

In accordance with a significant feature of the preferred embodiment, an electric drive motor is used to rotate the platform and a controller means is provided for selectively varying the speed and/or direction of rotation.

In accordance with a further feature of the preferred embodiment, means are provided for selectively varying the angle of inclination of the axis of rotation and thus, the tilt of the platform.

In accordance with a still further feature of the preferred embodiment, an array of permanent magnets is mounted on the platform to produce a low level magnetic field around the subject which, according to some users, may produce an enhanced therapeutic effect.

DESCRIPTION OF THE DRAWINGS

FIG. 4 is a longitudinal section, taken along the plane 4—4 in FIG. 3; and FIG. 5 is a plan view of the apparatus showing the disposition of an array of magnets in generating a magnetic field.

DETAILED DESCRIPTION

Figures 1, 2:
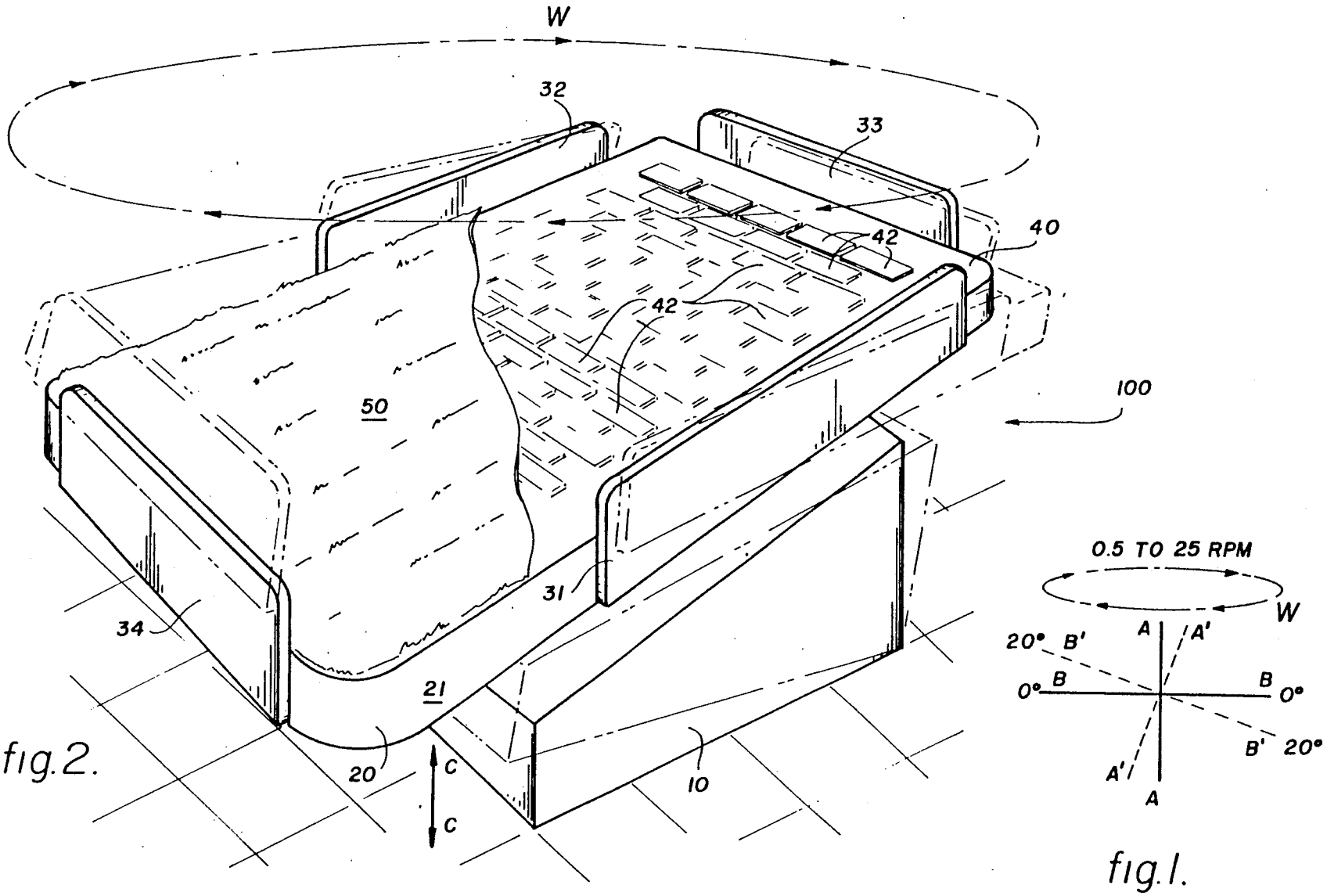
FIG. 1 is a schematic diagram indicating a tilted platform plane B'—B' upon which a human subject is supported L for rotation about axis A'—A' in accordance with the present invention.
FIG. 2 is a perspective view of a preferred embodiment of the invention, indicating the tilt and motion of the support platform.

FIG. 1 schematically depicts a vertical axis A—A having a platform plane B—B extending perpendicularly thereto, i.e. horizontally. In the use of an apparatus in accordance with the invention, the axis is inclined with respect to the vertical, i.e. to A'—A', to thus correspondingly tilt the platform plane to B'—B'. The angle of inclination of the axis may be as high as 20°, although an inclination of 18° is more usually preferred. In a typical application, the platform is rotated about the axis at a rate within the range of 0.5 to 25 revolutions per minute (RPM).

Attention is directed to FIG. 2 which depicts a preferred embodiment of the apparatus 100 in accordance with the invention. The apparatus 100 includes a platform 20 overlaid by a mattress 21 and a pad 50. In use, a human subject, i.e. a user, reclines on his back on the pad 50. Safety devices are provided to prevent the user from sliding off the pad during use of the apparatus. The safety devices include side panels 31 and 32, headboard 33, and footboard 34.

The platform 20 is supported on base 10 in which the drive system (to be more fully described hereinafter) is located. In accordance with a preferred embodiment, the tilt of the platform 20—from a horizontal plane B—B to a plane B'—B' (FIG. 1) is attained by moving one edge of the base 10 in the direction of arrows C—C (FIG. 2).

FIG. 2 also depicts the utilization of a plurality of flat permanent magnets 42 attached to a flexible sheet 40. The sheet 40 and magnets 42 are preferably placed between the mattress 21 and pad 50 to generate a low level magnetic field around the user.

Figure 3:
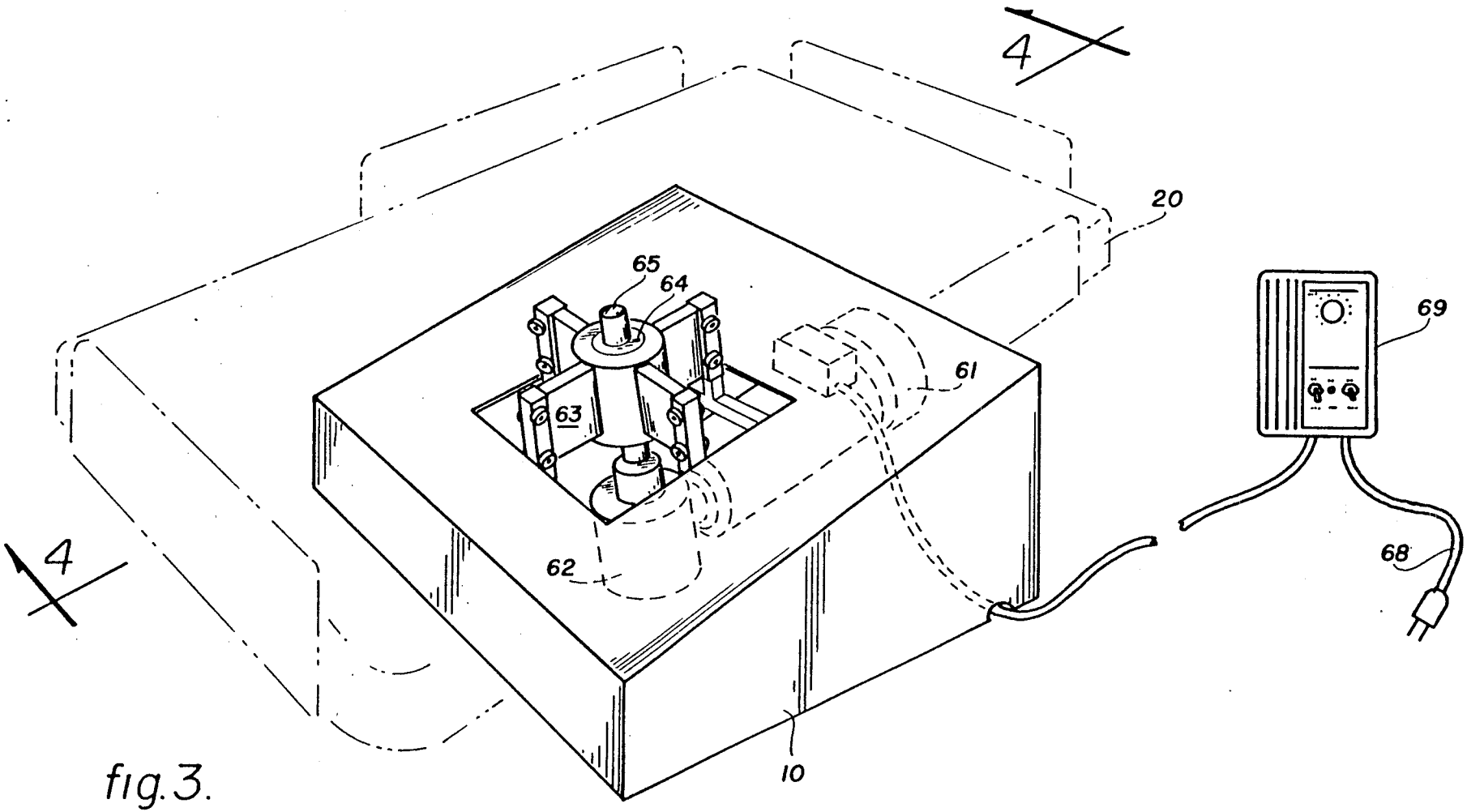
FIG. 3 is a partial, perspective view of the apparatus of FIG. 2, exposing the constructional details of the motor drive apparatus.

FIG. 3 shows, in partial perspective, the drive means associated with the apparatus 100, with the platform 20 being illustrated in an interrupted outline for clarity of illustration. The rotational movement of the platform 20, in the plane of the platform, is represented in FIGS. 1 and 2 by the arrow W. This rotational movement is achieved by means of an electric drive motor 61 and a speed reducing gear box 62 depicted in FIGS. 3 and 4. The motor 61 is mounted within the base 10 and directly coupled to the gear box 62 whose output shaft 65 extends through journal 64 supported in a cruciform carrier 63 bolted to the framework of the base 10.

The motor 61 is powered from a conventional source of electric current by a cable 68. A controller 69 is provided to vary the speed and direction of rotation of the motor 61. Typically, the motor 61 comprises a DC device and the controller 69 is a Silicon Controlled Rectifier having a variable power output. As is well known in the motor control art, the controller 69 can readily control the speed and/or direction of the motor 61 via the depicted switches and speed selector dial.

FIG. 4 is a longitudinal section—taken along section line 4—4 of FIG. 3—and more clearly illustrates some of the structural features of the apparatus 100. Note the placement of the array of magnets 42 on backing sheet 40 located between the mattress 21 and the pad 50.

Note also jack 70 (e.g. screw, hydraulic, or electromechanical) which has a traveller element secured to the base 10. By adjusting the length of the jack 70 to move the traveller element, the base 10, and platform 20, can be moved between the dashed line and solid line positions depicted in FIG. 4.

FIG. 4 also shows a drive flange 25 secured to the output shaft 65 of the gearbox 62. The flange 25 is affixed to the under surface of the platform 20 and transmits the forces generated by the platform to bearings in the drive system as well as transmitting the rotational movement of the shaft 65 to the platform 20.

FIG. 5 shows a plan view of the apparatus 100 with the pad 50 removed to reveal the array of magnets 42 which are preferably adhered to a flexible sheet 40. The flexible sheet 40 is preferably held to the surface of the mattress 21 by means of interactive fasteners 49. The fasteners can be selected from a wide variety of suitable configurations, but preferably comprise fasteners sold under the trademark Velcro. For convenience, the flexible sheet 40 can comprise separate portions 40*a* and 40*b*.

In a typical use of the apparatus depicted in FIGS. 1-5, a user will recline on the platform 20 on his back with his head proximate to headboard 33 and his feet proximate to footboard 34. Preferably, the user will locate his center of mass close to shaft 65 to avoid unbalancing the platform 20 as it rotates.

The platform 20 orientation or tilt will be adjusted to an angle such as is represented by plane B'—B' in FIG. 1. The motor 61 will then be energized to rotate the platform. As the platform rotates, each end, e.g. headboard 33, will traverse an inclined circular path whose elevation gradually varies from a high point above the median plane (B—B in FIG. 1) to a low point below the median plane. Thus, the elevation of the user's extremities (i.e. head and feet) will periodically and gradually vary to produce sensations which users report to be soothing and relaxing, having described them as "floating" or "weightlessness". The user's feet will of course traverse a circular path whose elevation changes substantially 180 out of phase with the elevation changes experienced by the user's head.

As previously mentioned, the tilt angle of the platform can be varied, preferably between 0° and 20° depending upon the motion sensation desired. Additionally, the rotational speed of the platform can also be varied between about 0.5 and 25 RPM, also dependent upon the motion sensation or experience desired by the user or an attending therapist. The frequency and duration of use sessions of course depend upon the desires of the user and/or attending therapist, if any. Users typically report beneficial therapeutic results with sessions having a duration between one half hour and one hour, repeated on a daily or weekly schedule.

While the foregoing description and accompanying drawings show and describe a preferred embodiment of this invention, it will be understood, of course, that minor changes may be made in the details of construction as well as in the combination, arrangement and composition of parts, without departing from the spirit and scope of the invention as claimed.

I claim:

1. Apparatus for periodically and gradually changing the elevation of the body extremities of a human subject, said apparatus comprising:

platform means for supporting said subject in a reclined orientation, said platform means having first and second ends and being mounted for rotation about an axis of rotation defined by a shaft extending perpendicular to said platform means;

said shaft extending at an incline to the vertical to thereby tilt said platform means from the horizontal; and electric drive means for rotating said platform means about said axis whereby the first and second ends of said platform means will traverse a tilted circular path whereby the elevation along said path varies periodically and gradually with respect to a horizontal reference plane.

2. The apparatus of claim 1 wherein said platform means includes:

a substantially planar, rigid support plate;

padding means covering an upper surface of said support plate and adapted to receive thereon the reclining body of said treatment subject; and restraint means for securing said subject safely upon the padding means covering said support plate.

3. The apparatus of claim 1, wherein said electric drive means include an electric motor having an output shaft; and speed reduction means operationally interconnecting said output shaft to said platform means.

4. The apparatus of claim 1, including means for selectively varying the tilt of said platform means.

* * * * *